US005764128A

United States Patent [19]

Kim et al.

[11] Patent Number: 5,764,128

[45] Date of Patent: Jun. 9, 1998

[54] COIL WINDING STRUCTURE OF FLYBACK TRANSFORMER

[75] Inventors: Jong-Dae Kim; Sung-Hwan Jung, both of Jeonrabuk-Do; Ha-Eun Nam, Seoul, all of Rep. of Korea

[73] Assignee: Daewoo Electronics Co., Ltd., Seoul, Rep. of Korea

[21] Appl. No.: 731,151

[22] Filed: Oct. 10, 1996

[30] Foreign Application Priority Data

Oct. 12, 1995 [KR] Rep. of Korea ..... 95-35053

[51] Int. Cl.[6] ..... H01F 5/00; H01F 27/30; H01F 27/24

[52] U.S. Cl. ..... 336/200; 336/212; 336/206; 336/221; 336/233

[58] Field of Search ..... 336/200, 206, 336/223, 212, 213, 221, 233, 234, 184

[56] References Cited

U.S. PATENT DOCUMENTS 3,231,841 1/1966 Ohtake ..... 336/184
3,371,244 2/1968 Boland ..... 336/234
4,327,348 4/1982 Hirayama ..... 336/184
4,639,708 1/1987 Weatherly ..... 336/200

FOREIGN PATENT DOCUMENTS 58-96709 8/1983 Japan ..... 336/200

*Primary Examiner*—Michael L. Gellner
*Assistant Examiner*—Anh Mai
*Attorney, Agent, or Firm*—Beveridge, DeGrandi, Weilacher & Young LLP

[57] ABSTRACT

A coil winding structure of a flyback transformer comprises a plurality of layers of a coiled-circuit pattern sheet. The coiled-circuit pattern sheet includes a tubular sheet, a coiled-circuit pattern formed around the tubular sheet, and a magnetizable core inserted into the tubular sheet. The coiled-circuit pattern sheet and the magnetizable core have a shape of an elongated flexible strip. The coiled-circuit patterns are electrically connected in series with each other, and the magnetizable cores are connected with each other by a conductive binder and so on, so as to form a closed circuit in a zig-zag formation.

2 Claims, 3 Drawing Sheets

COIL WINDING STRUCTURE OF FLYBACK TRANSFORMER

BACKGROUND OF THE INVENTION

1. Field of the Invention

The present invention relates to a coil winding structure of a transformer, and more particularly, to a coil winding structure of a flyback transformer for applying high-voltage current to a cathode-ray tube.

2. Description of the Prior Art

Generally, a cathode-ray tube includes an electron gun emitting thermal electron beam and a photosensitive screen producing desired colors and images by the emitted electron beam. The photosensitive screen is coated with a combination of R, G and B type fluorescent materials. Also the cathode-ray tube is provided with a deflection coil, a focusing coil and an accelerating coil, etc., for controlling the emitted electron beam.

Typically, the cathode-ray tube requires a high-voltage of 25,000 V or so for deflecting and focusing the electron beam, and this high voltage current is generated by a flyback transformer and applied to the cathode-ray tube.

FIG. 1 is a perspective view illustrating an exploded state of a conventional flyback transformer, which will be described below.

As illustrated in FIG. 1, the conventional flyback transformer includes a casing 10 having a through-hole 12, a cylindrical secondary coil assembly 30 inside the casing 10, a cylindrical primary coil assembly 20 inserted into the secondary coil assembly 30, a magnetizable core 40 inserted into the primary coil assembly 20, an anode cap 14 attached to the secondary coil assembly 30, a cover 50 for the casing 10, and a condenser 52 inside the cover 50, etc.

The primary and secondary coil assemblies 20, 30 respectively consist of an insulating bobbin 24, 34 and primary and secondary coil windings 22, 32 around the bobbins 24, 34. All turns of the coil windings 22, 32 are insulated from each other.

A voltage applied to the flyback transformer is rectified by the condenser 52, flows to the primary coil assembly 20, and consequently to the primary coil winding 22.

The voltage applied to the primary coil winding 22, that is, a primary voltage, provides a large secondary voltage by mutual induction effect. As is well known, the value of the secondary voltage is determined depending on the ratio of the number of turns of the secondary coil winding 32 to that of the primary winding 22. Thereafter, the induced secondary voltage is applied through the anode cap 14 to the cathode-ray tube and then functions by emitting, accelerating, and focusing the electron beam.

In the above-described conventional flyback transformer, however, achieving uniformity in the characteristics thereof is not easy. Namely, in the coil winding process, the adjacent coil turns are very likely to overlap or separate from each other. Therefore, all of those problems lead to variation or fluctuation in the characteristics of the flyback transformer, consequently resulting in poor high voltage regulation thereof.

Furthermore, the demand for large sized cathode-ray tubes has increased, and therefore various devices for supplying voltage to the cathode-ray tube, especially the flyback transformer which requires a greater number of turns in the coil windings has lead to a resultant increase in the overall size of the flyback transformer.

SUMMARY OF THE INVENTION

To solve the above problems, an object of the invention is to provide a new coil winding structure of a flyback transformer for achieving uniformity in the characteristics of the flyback transformer and also the compactness thereof.

To achieve the object of the invention, there is provided a coil winding structure of a flyback transformer, which comprises a plurality of layers of a coiled-circuit pattern sheet member. The coiled-circuit pattern member includes a tubular sheet, a coiled-circuit pattern formed around the tubular sheet, and a magnetizable core member inserted into the tubular sheet.

The coiled-circuit pattern sheet member and the magnetizable core member are preferably flexible, and even more preferably in a shape of an elongated flexible strip.

Preferably, the coiled-circuit patterns are electrically connected in series with each other, and the magnetizable core members are connected with each other by a conductive binder and so on, so as to form a closed circuit in a zigzag formation.

BRIEF DESCRIPTION OF THE DRAWINGS

The above, other features and advantages of the invention will be apparent from the following detailed description of the preferred embodiments of the invention in conjunction with the following drawings in which.

DETAILED DESCRIPTION OF THE PREFERRED EMBODIMENT

Hereinafter, the invention will be described in further detail by way of a preferred embodiment with reference to the accompanying drawings.

Figure 2:
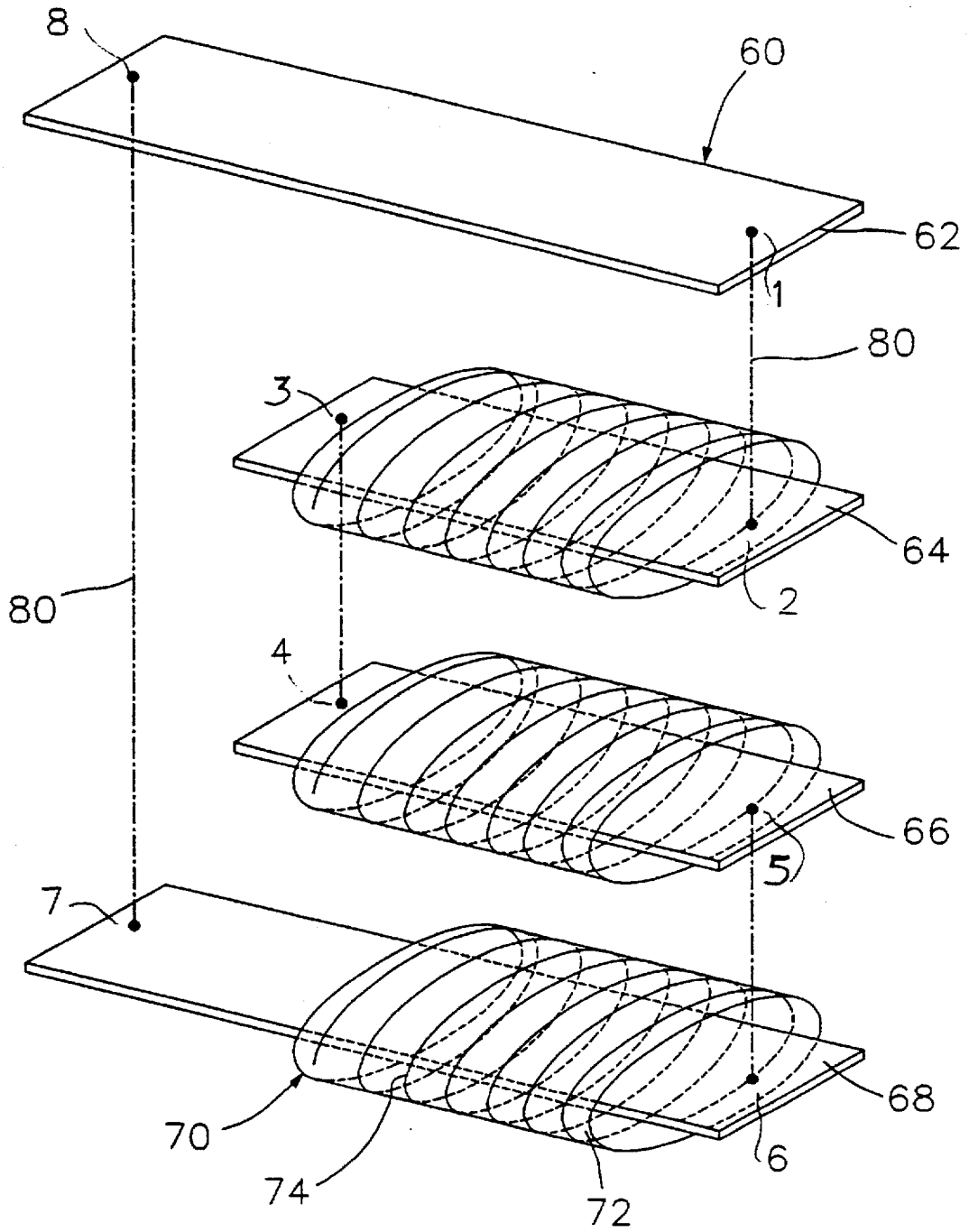
FIG. 2 is a perspective view showing an exploded state of a preferred embodiment of the invention.

FIG. 2 illustrates perspectively an exploded state of a coil winding structure of a flyback transformer (hereinafter, referred to as "FBT") according to this invention. As shown in the figure, the coil winding structure comprises a plurality of coiled-circuit pattern sheet members 70 and a plurality of magnetizable core members 62, 64, 66, and 68.

Each of the coiled-circuit pattern members 70 includes a flexible tubular sheet 72 in which a coiled-circuit pattern 74 is formed. The coiled-circuit pattern 74 is wound spirally around the tubular sheet 72 in such a manner that the coiled-circuit pattern 74 extends from one end of the tubular sheet 72 to other end of the tubular sheet 72 in a helical form. All coiled-circuit patterns of the coiled-circuit pattern sheet members 70 are connected in series. Furthermore, the tubular coiled-circuit pattern sheet member 70 is preferably flexible, and even more preferably in a shape of an elongated flexible strip.

Preferably, the tubular sheet 72 is made of a thin insulating material such as polyimide film. It is desirable that the individual coiled-circuit of the coil-circuit pattern 74 be very fine and uniformly arranged. This configuration of the coiled-circuit pattern 74 may be obtained by using a conventional process such as photolithograpy, etc. as used in the manufacture of a printed circuit board.

Preferably, the magnetizable core member 60 is plate-like, even more preferably flexibly strip-like.

As illustrated in FIG. 2, a plurality of the coiled-circuit pattern sheet members 70 are layered to form the coil winding structure of the inventive object. FIG. 2 is illustrating only a three coiled-circuit pattern sheet member 70 to be layered, but a greater number of the coiled-circuit pattern sheet members 70 may be layered to form the coil winding structure, if desired.

Figure 3:
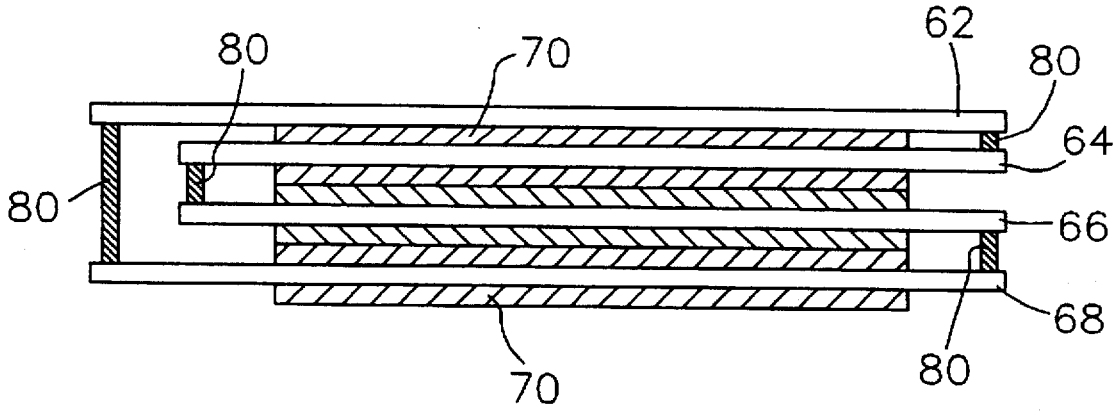
FIG. 3 is a longitudinal side view showing the layered configuration of the embodiment in FIG. 2.

In the coil winding structure as constructed above, each layer of the coiled-circuit pattern sheet member 70 includes the magnetizable cores 64, 66, 68 respectively. The respective magnetizable cores 64, 66, 68 are connected with each other, as illustrated with a dash-dot line in FIG. 2, to form a closed circuit in a zigzag formation together with an additional magnetizable core 62. That is, as shown in FIGS. 2 and 3, the magnetizable core members are stacked in layers in such a manner that a first magnetizable core member or the additional magnetizable core member 62 is connected to a second magnetizable core member 64 at one end 1, 2 of the magnetizable core members 62 and 64, respectively, and the second magnetizable core member 64 is connected to a third magnetizable core member 66 at the other end 3, 4 of the magnetizable core members 64 and 66. In the same manner, the third magnetizable core member 66 is connected to a fourth magnetizable core member 68 at one end 5, 6 of the magnetizable core members 66 and 68. A last or the fourth magnetizable core member 68 is connected to the first magnetizable core member 62 at the other end 7, 8 of the magnetizable core members 62 and 68, respectively. By the connection in such a manner, the magnetizable core members 62, 64, 66, and 68 form a serial closed circuit in a zig-zag way.

FIG. 3 illustrates a sectional side view of the coil winding structure of the invention.

As illustrated in FIG. 3, each of the magnetizable cores 62, 64, 66, 68 may be connected to each other through conductive binders 80 disposed between every two magnetizable core members 62, 64, 66, and 68. The conductive binders 80 electrically connect the core members 62, 64, 66, and 68.

Preferably, the respective coiled-circuit patterns 74 are connected in series with each other, for example, by appropriately connecting the leading terminal and the ending terminal of each of the coiled-circuit patterns 74.

Figure 1:
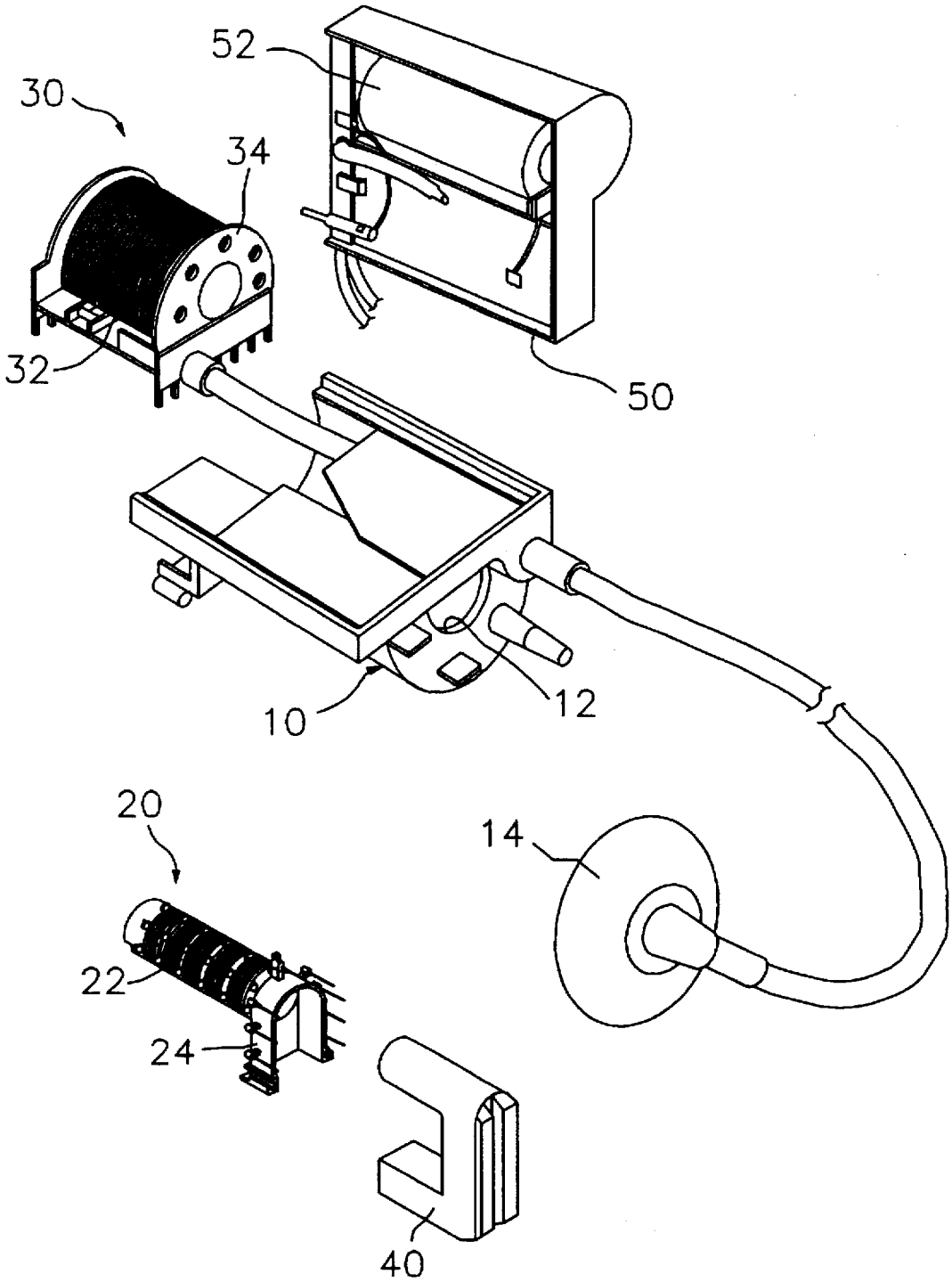
FIG. 1 PRIOR ART
FIG. 1 is a perspective view showing an exploded state of a conventional flyback transformer.

As clearly described in the above, the coil winding structure of FBT according to the invention does not need a large bobbin 24, 34 as illustrated in FIG. 1 of the prior art because the number of turns of the coil windings can be considerably increased without increasing the overall size of the FBT, even in case that the FBT requires a greater number of turns of coil windings.

Also, the coil winding structure of the invention includes a plurality of the coiled-circuit patterns 74, which are uniformly and regularly layered. Furthermore, the coiled-circuit patterns 74 include a large number of coiled-circuits which are very fine and uniformly and regularly arranged. Therefore, all of these features naturally result in great uniformity in the functional characteristics of the FBT.

While the present invention has been particularly shown and described with reference to preferred embodiments thereof, it will be understood by those skilled in the art that various changes in form and details may be effected therein without departing from the spirit and scope of the invention as defined by the appended claims.

What is claimed is:

1. A coil winding structure of a flyback transformer comprising:

a plurality of coiled-circuit pattern sheet members, each of the coiled-circuit pattern sheet members having a tubular sheet in which a coiled-circuit pattern is formed, the coiled-circuit pattern being wound spirally around the tubular sheet in such a manner that the coiled-circuit pattern extends from one end of the tubular sheet to the other end of the tubular sheet in a helical form, all coiled-circuit patterns of the coiled-circuit pattern sheet members being connected in series; and a plurality of magnetizable core members respectively inserted in the tubular sheet, each of the magnetizable core members having a shape of an elongated plate, the magnetizable core members being stacked in layers and connected in such a way that one end of each magnetizable core member is connected to an adjacent one end of an adjacent magnetizable core member in said stacked layers, that each of the other ends of the magnetizable core members is connected to an adjacent other end of in adjacent magnetizable core member in said stacked layers, and the other end of the last magnetizable core member in said stacked layers in connected to the other end of the first magnetizable core member in the stacked layers, thereby the magnetizable core members form a serial closed circuit in a zig-zag way.

2. The coil winding structure as claimed in claim 1, wherein the magnetizable core members are connected to each other through conductive binders disposed between every two magnetizable core members.

* * * * *